US012065833B1

(12) United States Patent
Robertson

(10) Patent No.: US 12,065,833 B1
(45) Date of Patent: Aug. 20, 2024

(54) ARCHITECTURAL FLOOR AND ROOF FRAMING SYSTEM

(71) Applicant: Douglas R. Robertson, Saratoga, CA (US)

(72) Inventor: Douglas R. Robertson, Saratoga, CA (US)

( * ) Notice: Subject to any disclaimer, the term of this patent is extended or adjusted under 35 U.S.C. 154(b) by 198 days.

(21) Appl. No.: 17/520,489

(22) Filed: Nov. 5, 2021

(51) Int. Cl.

| | |
|---|---|
| ***E04C 5/08*** | (2006.01) |
| ***E04B 1/26*** | (2006.01) |
| ***E04B 1/28*** | (2006.01) |
| ***E04B 7/02*** | (2006.01) |
| ***E04C 3/14*** | (2006.01) |
| ***E04C 3/28*** | (2006.01) |

(52) U.S. Cl.
CPC ..... *E04C 5/08* (2013.01); *E04B 1/26* (2013.01); *E04B 1/28* (2013.01); *E04B 7/022* (2013.01); *E04C 3/145* (2013.01); *E04C 3/28* (2013.01)

(58) Field of Classification Search
CPC ... E04B 1/26; E04B 1/28; E04B 7/022; E04C 5/08; E04C 3/145; E04C 3/28
See application file for complete search history.

(56) References Cited

U.S. PATENT DOCUMENTS

| | | | | |
|---|---|---|---|---|
| 749,987 | A * | 1/1904 | Franke | B21B 1/163 52/856 |
| 3,079,649 | A * | 3/1963 | Willatts | E04C 3/14 52/843 |
| 3,251,162 | A * | 5/1966 | Strimple | E04C 3/18 52/223.8 |
| 3,925,938 | A * | 12/1975 | Molen | E04D 3/352 52/480 |
| 5,175,968 | A * | 1/1993 | Saucke | E04C 3/18 52/223.8 |
| 8,607,528 | B2 * | 12/2013 | Ellen | E04C 3/38 52/73 |
| 2011/0016824 | A1 * | 1/2011 | Thornton | E04C 3/14 52/854 |
| 2014/0259463 | A1 * | 9/2014 | Chandra | E04C 3/28 52/309.1 |
| 2022/0220740 | A1 * | 7/2022 | Thompson | E04B 5/14 |

FOREIGN PATENT DOCUMENTS

| | | | | |
|---|---|---|---|---|
| WO | WO-2012083391 | A1 * | 6/2012 | E04B 1/18 |

* cited by examiner

*Primary Examiner* — Christine T Cajilig
(74) *Attorney, Agent, or Firm* — Spano Law Group; Joseph S. Spano

(57) ABSTRACT

A sustainable, integrated framing system and methods of assembly thereof are presented herein. In some embodiments, a roof, primary structure, and a ceiling are structurally defined and supported by pre-fabricated load bearing ribs of the sustainable, integrated framing system. The pre-fabricated load bearing ribs facilitate efficient building erection on-site without expensive and time consuming welding and associated inspections. Each rib includes a compression chord element, a web element extending below the compression chord element, and one or more adjustable tension elements embedded within the web element. An end support node is attached to each end of a load bearing rib structure and the one or more tension elements are tensioned against the end support node (s). In some embodiments, the top profile, the bottom profile, or both, of a web structure are shaped to meet aesthetic or functional design objectives independent of the load carrying capability of the load bearing rib.

25 Claims, 10 Drawing Sheets

ARCHITECTURAL FLOOR AND ROOF FRAMING SYSTEM

TECHNICAL FIELD

The described embodiments relate to structural members and systems, and more particularly to pre-stressed structural members and systems for the construction of floors and roofs.

BACKGROUND INFORMATION

Various roof and floor framing systems are commonly utilized to span mid to long distances (e.g., 40 feet or more) encountered in many types of buildings. Currently, the most cost effective of these roof and floor framing systems rely on either predesigned and prefabricated open web steel trusses or custom designed trusses fabricated of steel or timber. Custom designed and fabricated trusses are typically much more expensive than pre-designed, fabricated trusses. Pre-designed, fabricated trusses are typically selected from an existing catalog of available trusses based on specific project loads and span. Pre-designed trusses are typically constructed at fabrication shops with tooling and processes already in place to cost efficiently and repetitively fabricate the predesigned trusses.

Prefabricated trusses are typically manufactured off-site and transported to the construction site in a single span, or in multiple sections. Shipping to the construction site in multiple sections is required in instances when the length of span exceeds permitted shipping lengths. Multiple sections are assembled on-site to realize a full length span by field splicing the top and bottom chords of the truss structure. Unfortunately, on-site assembly of truss sections adds cost and erection time to the project due to relatively expensive field bolting, welding, or both, and associated inspections.

Prefabricated trusses are typically fabricated in one configuration and assembled in a one dimensional array at regular spacing intervals. Typically, the top chord member of each truss of the array is a linear structural member, and the top chord members are erected in position in a horizontal plane (i.e., approximately perpendicular to the direction of gravitational force). Similarly, the bottom chord member of each truss of the array is located in parallel plane below the top plane. In this manner, the array of trusses forms a top level plane upon which a floor or roof structure may be constructed and a bottom level plane upon which a ceiling structure may be constructed. In one example, a roof subassembly is often constructed using a secondary assembly system mounted to the top of the flat subroof plane, attached to the array of trusses to create sufficient roof slope for proper roof drainage.

Custom designed trusses may be constructed with curved or sloping top and bottom chords and intermittent web members that connect the top and bottom chords. The custom designed truss member is repeated across the array, resulting in a two dimensional truss profile across the structural assembly. However, to achieve the two-dimensional profile, the web of each truss connecting the curved or sloping top and bottom chords varies in height along the length of the truss. In addition, each connection of web members to top and bottom chords includes a unique joint configuration, which complicates manufacture and assembly processes. As a result the cost to fabricate such a truss is considerably higher than the cost of repetitively fabricated, linear truss shapes easily manufactured in higher volume.

In some examples, assembled trusses are left fully exposed to view from the space below. In some other examples, assembled trusses are concealed with a separate ceiling subassembly. If left fully exposed, ductwork and other utilities are also left exposed, leaving a more industrial, exposed structural appearance. If a ceiling subassembly is installed, the trusses, ductwork, and other utilities are concealed from view by the separate ceiling assembly. In some examples, a ceiling subassembly includes a structural falsework to support acoustic tile, gypsum board, or other finish ceiling materials placed to create a level ceiling system.

In summary, the typical approach to the construction of buildings today includes multiple components: structural trusses, a sloped roofing subassembly mounted to the structural trusses from above, and optionally, a ceiling subassembly mounted to the structural trusses from below.

Currently, pre-designed truss systems are often selected to save cost compared to traditional custom designed truss systems. However, the implementation of pre-designed truss systems gives rise to a number of disadvantages. For example, the need to separately construct a roof subassembly to achieve roof slope and a separate ceiling assembly adds significant cost and time to a construction project. Moreover, linear trusses are often aesthetically unacceptable or undesirable, requiring construction of separate subassemblies to achieve a desired architectural design.

As spans become longer, traditional timber trusses typically become less economical or impossible to realize due to connection capacity limits and costs. Structural steel is the preferred material for longer spans, but steel is relatively expensive. Furthermore, while reclaimed steel can be used for steel trusses, steel is not a renewable resource and therefore typically carries a larger carbon footprint. In another example, the field assembly of steel trusses requires expensive and inspection intensive site fastening (e.g., welding, bolting, etc.).

In summary, current mid and long span roof and floor framing systems suffer from a number of disadvantages from both a cost and sustainability perspective. The economic cost and environmental issues become particularly acute when the required span exceeds 40 feet in length, complex architectural features are incorporated, or both. A sustainable roof and floor framing system integrating high stiffness support, roof shape, and ceiling shape functions with a high degree of architectural design flexibility is desired. In addition, it is desired that the components of the sustainable roof and floor framing system be light weight, compact, easily fabricated off-site using automated technology available to the mass timber construction market and be assembled on-site with a minimum of costly field fastening operations and inspections.

SUMMARY

A sustainable, integrated framing system and methods of assembly thereof are presented herein. In some embodiments, a roof, primary structure and a ceiling or a floor primary structure are structurally defined and supported by pre-fabricated load bearing ribs of the sustainable, integrated framing system. The pre-fabricated load bearing ribs facilitate efficient building erection on-site without expensive and time consuming welding and associated inspections.

In one aspect, a sustainable, integrated framing system includes a number of load bearing ribs. Each rib includes one or more compression chord elements, a web element extending below the compression chord elements, and one or more adjustable tension elements embedded within the web element. In a further aspect, an end support node is attached to each end of a load bearing rib structure, and the one or more tension elements are tensioned against the end support nodes.

In a further aspect, a number of load bearing ribs are arranged in parallel in one direction to form a roof or floor of a building structure. An arrangement of load bearing ribs in a single direction is particularly well suited for minimum cost and moderate span lengths.

In another further aspect, a number of load bearing ribs are arranged in two different directions in a grid configuration to form a roof or floor of a building structure. In this arrangement, the arrangement of load bearing ribs oriented in one direction effectively braces the load bearing ribs arranged in a different direction to stabilize the roof or floor structure under gravity, seismic, and wind loads.

In another further aspect, a number of load bearing ribs arranged in parallel in one direction are laterally braced at the bottom web structure to stabilize each load bearing rib and prevent lateral buckling under gravity loading, seismic loading, and wind loading.

In another further aspect, the depth of a web structure is not uniform along the length of a load bearing rib. In this manner, the bottom profile of a web structure is shaped to meet aesthetic or functional design objectives independent of the load carrying capability of the load bearing rib.

In another further aspect, a load bearing rib includes a top web structure extending above the compression chord member(s). In some embodiments, the height of the top web structure is uniform along the length of the load bearing rib. In some other embodiments, the height of the top web structure is non-uniform along the length of the load bearing rib.

In some embodiments, some or all load bearing ribs of an array of load bearing ribs have different top and/or bottom profiles. In these embodiments, the shape of the overall topography formed by the top and/or bottom profiles of the array of load bearing ribs is unique in three dimensions. In some embodiments, a ceiling is formed using the array of load bearing ribs to support a ceiling or ceiling subassembly having a complex three-dimensional profile visible to the room environment. In some embodiments, a roof is formed using the array of load bearing ribs to support a roofing subassembly having a complex profile to promote three dimensional roof drainage or to create a more complex roofscape.

In another further aspect, the web structure includes one or more transverse penetrations, for example, to pass mechanical, electrical, and plumbing elements through the load bearing rib or for aesthetic purposes.

In another further aspect, load bearing ribs are manufactured off-site in linear sections and assembled and installed together, on-site.

The foregoing is a summary and thus contains, by necessity, simplifications, generalizations and omissions of detail; consequently, those skilled in the art will appreciate that the summary is illustrative only and is not limiting in any way. Other aspects, inventive features, and advantages of the devices and/or processes described herein will become apparent in the non-limiting detailed description set forth herein.

DETAILED DESCRIPTION

Reference will now be made in detail to background examples and some embodiments of the invention, examples of which are illustrated in the accompanying drawings.

A sustainable, integrated framing system and methods of assembly thereof are presented herein. The sustainable, integrated framing system is suitable for relatively large, unsupported spans found in the floor and roof assemblies of many modern, open concept buildings. As a timber-based framing system, the timber structural elements are renewable and retain the carbon sequestered during tree growth prior to harvest.

In some embodiments, a roof, primary structure, and a ceiling are structurally defined and supported by pre-fabricated load bearing ribs of the sustainable, integrated framing system. Furthermore, the resulting roof and ceiling structures may be constructed with unique, complex three-dimensional topography. The pre-fabricated load bearing ribs are designed and detailed using available software based design tools, such as Computer Aided Design (CAD) software tools, Building Information Modeling (BIM) software tools, other structural analysis software, etc. The resulting Building Information Model (BIM) may be directly communicated to Computer Numerically Controlled (CNC) cutting and gluing equipment for automated fabrication. The pre-fabricated load bearing ribs facilitate efficient building erection on-site without expensive and time consuming welding and associated inspections.

In one aspect, a sustainable, integrated framing system includes a number of load bearing ribs. Each rib includes one or more compression chord elements, a web element extending below the compression chord element, and one or more adjustable tension elements embedded within the web element. Each load bearing rib is fabricated from commercially available, sustainable timber framing components.

Figure 1:
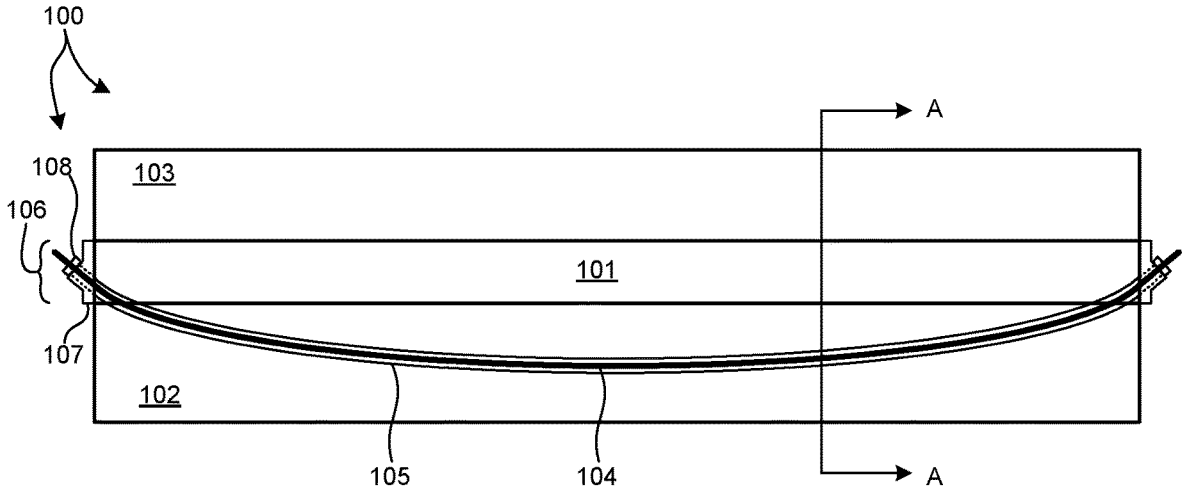
FIG. 1 is a diagram illustrative of a side view of a load bearing rib in one embodiment.
Figure 3:
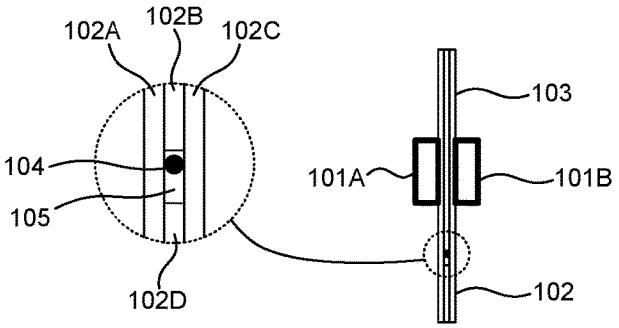
FIG. 3 is a diagram illustrative of a cross-sectional view of the load bearing rib depicted in FIG. 1.

FIG. 1 depicts a load bearing rib 100 in one embodiment. FIG. 3 depicts a cross-sectional view of load bearing rib 100 as indicated by cross-section, A, depicted in FIG. 1. As depicted in FIGS. 1 and 3, load bearing rib 100 includes one or more chord elements 101A and 101B.

As depicted in FIG. 1, each chord element 101A and 101B extends the full length of load bearing rib 100. In the embodiment depicted in FIGS. 1 and 3, each chord element 101A and 101B has a rectangular cross-section. However, in general, any suitable cross-sectional shape may be contemplated within the scope of this patent document. Each chord element is fabricated from materials including, but not limited to, dimensionally sawn lumber, a mass timber product such as Cross-laminated timber (CLT), Nail Laminated Timber (NLT), Dowel Laminated Timber (DLT), Super Plywood, etc., a manufactured timber product such as Laminated Veneer Lumber (LVL), Parallel Strand Lumber (PSL), glue laminated beams, etc., cold formed light gauge steel, hot rolled structural steel, or timber reinforced by light gauge structural steel fastened to the timber (e.g., using glue, mechanical fasteners, etc.).

In general, one or more chord members may be placed on one or both sides of a web structure or on top of a web structure. In some embodiments, a chord member is bonded to the web structure using adhesive products, mechanically fasteners, etc., either at a manufacturing facility or on-site. For example, a load bearing rib may include one chord element disposed on one side of a web structure 102, two chord elements disposed on either side of web structure 102 as depicted in FIG. 3, or two or more chord elements disposed on either side of web structure 102.

In addition, as depicted in FIGS. 1 and 3, each load bearing rib includes a web structure 102 that also extends the full length of load bearing rib 100. As depicted in FIG. 3, web structure 102 includes at least three panel layers laminated together using standard adhesive products. Each panel is fabricated from one or more sheet products placed edge to edge along the full length of the load bearing rib 100. Exemplary sheet products include, but are not limited to plywood, oriented strand board, fiber cement board, composite sheet, plastic laminate, or other suitable material. The thickness of the panels may vary to suit the size of any embedded tension elements, the span of the load bearing rib, expected loading, desired aesthetic preferences, etc. Panel sheet products may be arranged such that the direction of maximum extent is aligned vertically or horizontally based on panel size and desired depth of the load bearing rib. Vertical joints in each lamination are staggered horizontally relative to vertical joints in any adjacent lamination to create a single bonded, vertically oriented web that extends the full length of the load bearing rib between the end support nodes.

As depicted in FIG. 3, the outer panels, e.g., panels 102A and 102C, are solid sheets. However, the interior panel is subdivided into two sections, e.g., subsections 102B and 102D. A void between subsections 102B and 102D, and between outer panels 102A and 102C forms a tunnel 105 within web structure 102 that is continuous from one end of load bearing rib 100 to the opposite end. In some embodiments, the tunnel 105 is fabricated by machining away the center panel, e.g. using a computer numerically controlled (CNC) router, to create the subdivision between panels 102A and 102C. In some other embodiments, the subsectional panels are separately cut and assembled together with space between them as part of the gluing process of web structure 102.

In general, a tunnel may be fabricated within one or more panel laminations by cutting the lamination along the length of the load bearing rib, or otherwise including a vertically spaced gap between upper and lower lamination pieces along the length of the load bearing rib between the end support nodes. Each tunnel is fabricated to a prescribed shape profile prior to placing and gluing panel laminations to form the web structure of each load bearing rib.

Tunnel cuts may be performed using any of a standard gantry, table, or portable CNC cutting machine, saw, or other cutting tools to generate the prescribed curved profile. In general, a tunnel may be cut into a layer to a depth that is only a fraction of the total thickness of one or more layers, through an entire layer, through multiple layers, or any combination thereof.

Figure 16:
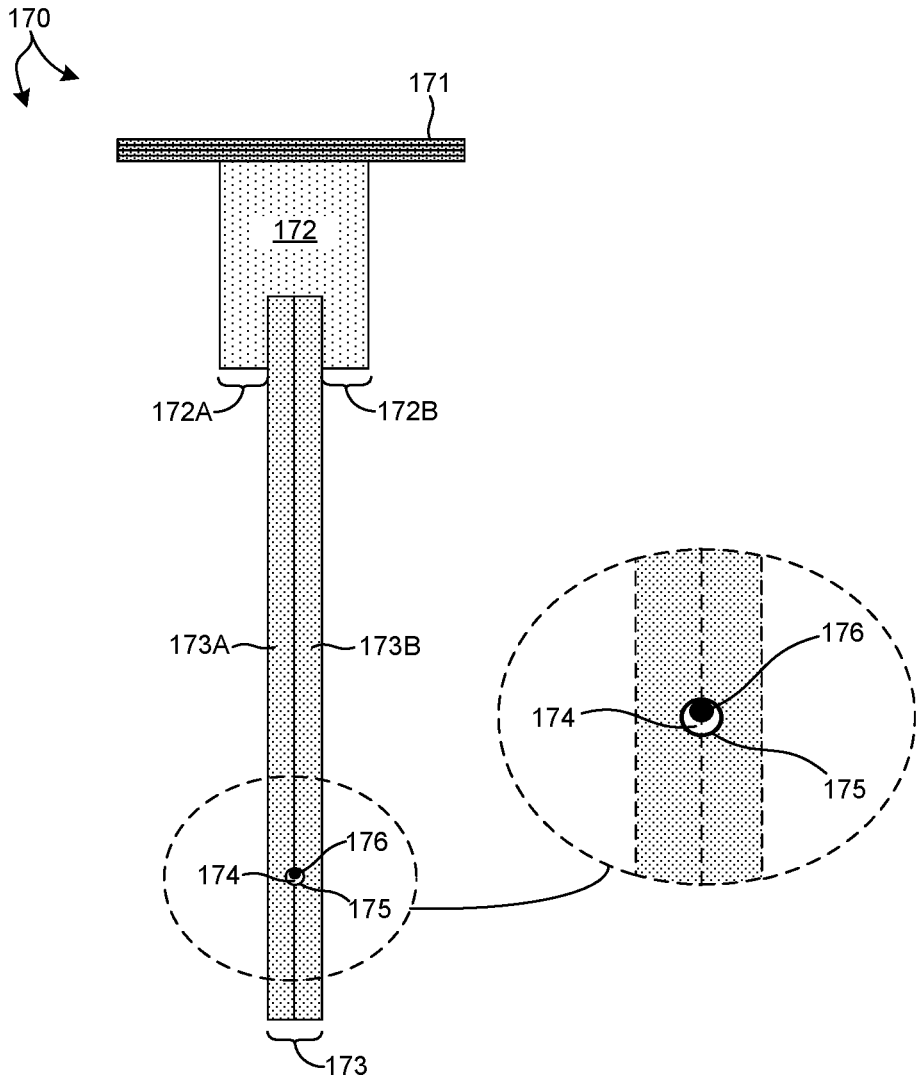
FIG. 16 is a diagram illustrative of a cross-sectional view of a load bearing rib and a diaphragm attached to the load bearing rib in another embodiment.

FIG. 16 is a diagram 170 illustrative of a cross-sectional view of a load bearing rib and a diaphragm attached to the load bearing rib. As depicted in FIG. 16, a web structure 173 extends below compression chord element 172. As depicted in FIG. 16, portions 172A and 172B of compression chord element 172 are disposed adjacent to web structure 173 on both sides of web structure 173. In addition, in the embodiment depicted in FIG. 16, web structure 173 includes two panel layers, 173A and 173B, laminated together. A channel is machined into panel layer 173A, panel layer 173B, or both, and tunnel 134 is formed when panel layers 173A and 173B are laminated together. In the embodiment depicted in FIG. 16, the web structure includes two layers, and a tunnel formed from cuts to a fraction of the total thickness of both layers. In the depicted embodiment, duct 175 is located within the tunnel 174 and a tension element 176 is located within the duct 175. Diaphragm 171 is attached to the top of chord element 172. Diaphragm 171 extends along the length of chord element 172 and extends in a direction perpendicular to the depicted load bearing rib, and is attached to other load bearing ribs. In this manner, diaphragm 171 forms a structural plane connecting multiple load bearing ribs at the top of the compression chord elements to laterally brace the compression chords, support gravity loads, and support seismic loads.

As depicted in FIGS. 1 and 3, a slender, high strength tension element 104 is located within tunnel 105 and extends beyond both ends of load bearing rib 100. Tension element 104 is fabricated from materials suitable to sustain high tensile stress. Exemplary materials include, but are not limited to, strand, bar, rod, or cable fabricated in whole or in part from steel, fiberglass, carbon fiber, cobalt, other suitable engineered materials, or any combination thereof. In a preferred embodiment, tension element 104 is a high strength material capable of sustaining relatively high tensile stress.

Importantly, tunnel 105 is fabricated in a curved shape that reaches its highest point (highest vertical elevation or vertical position) at each end of load bearing rib 100. In a preferred embodiment, the curved shape terminates at each end of load bearing rib 100 at a vertical elevation at or near the vertical centroid of chord element 101. In some embodiments, the curved shape slopes downwards and reaches its lowest vertical elevation at or near the mid-span of load bearing rib 100, then slopes upwards to opposite ends of the load bearing rib. In general, the path traced by the tunnel 105 is shaped as a curve having zero slope at a single location between endpoints of the load bearing rib. The location of zero slope is typically located at or near the mid-span of the web structure in the longitudinal direction where a vertical elevation of the tension element reaches its lowest point. In this manner, the load carried by the tension element 104 is evenly distributed along the curved path. In some embodiments the curved shape is a parabolic shape, a catenary shape, or any other suitable shape having zero slope at a single location between the endpoints of the load bearing rib.

In some embodiments, tension element 104 is located in a duct (not shown) located within tunnel 105 along a least a portion of the length of tunnel 105, e.g., near the ends of tunnel 105, or the entirety of tunnel 105. In general, the duct may be any suitable structure, e.g., polymer tube, metal tube, etc. In some embodiments, the duct is installed during fabrication of a load bearing rib in a CNC cut tunnel to facilitate smooth and easy field threading of a tension element. In addition, a duct may be desirable to reduce friction when the tensile element is installed, reducing friction losses during tensile loading, or both.

In a further aspect, an end support node is attached to each end of a load bearing rib structure. An end support node may be fabricated from any of timber, steel, concrete, masonry, or any other building material.

As depicted in FIG. 1, at each end of the load bearing rib 100, the chord member 101 and a portion of web structure 102 terminate against a reaction plate 107 of end support node 106. In general, the one or more chord members of a load bearing rib structure terminate against a reaction plate, however it is not required that the web structure terminate against the reaction plate. In addition, at each end of the load bearing rib 100, tension element 104 extends through a hole in reaction plate 107. In a preferred embodiment, tension element 104 extends through reaction plate 107 at approximately the middle of the depth of chord member 101. A tensioning device pulls on tension element 104 and pushes against reaction plate 107 until the desired tension of tension element 104 is reached. A locking element 108 (e.g., clamp, nut, wedge, etc.) locks tension element 104 to reaction plate 107 to maintain the tension after removal of the tensioning device. In this manner, the end support node transfers the horizontal tension component of the tension element 104 directly into chord member 101 as a compression load without imposing eccentricities that would otherwise lead to chord bending.

In some embodiments, at each end of the load bearing rib 100, the chord member 101 also rests against a horizontally oriented support structure to position the load bearing rib 100 with respect to the overall building structure and provide support to the load bearing rib before and after any tendon elements are stressed and locked into position.

Figure 2:
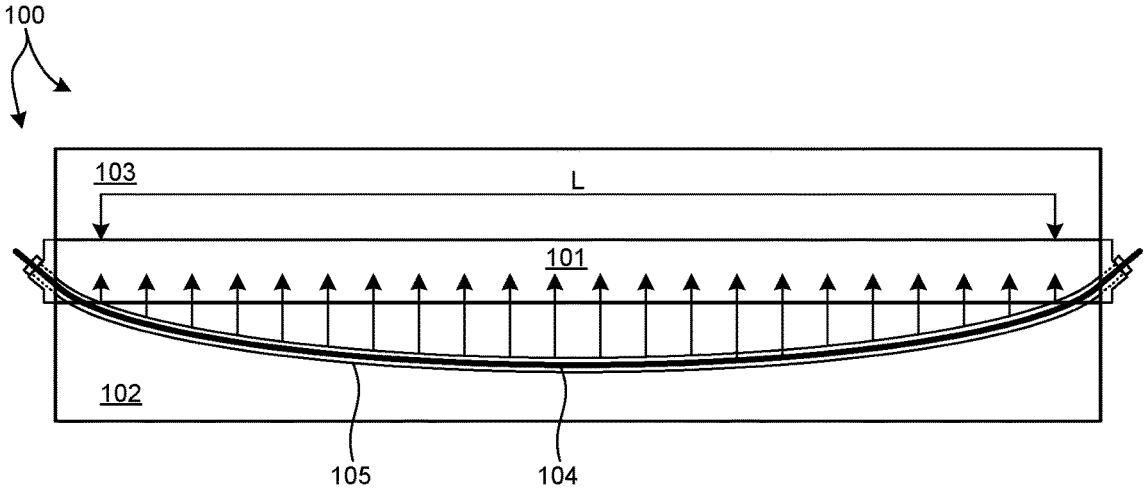
FIG. 2 is a diagram illustrative of the load bearing rib depicted in FIG. 1, and subject to a distributed load, L, applied along its length.

FIG. 2 depicts load bearing rib 100 subject to a distributed load, L, applied along its length. In general, a chord element is located at or near the top of each load bearing rib, and generally below any floor or roof diaphragm. As depicted in FIG. 2, a distributed load, L, is applied along the length of load bearing rib 100. The distributed load induces a bending moment on load bearing rib 100. Similar to the top chord of a traditional truss structure, the chord element 101 is placed in compression due to the bending moment induced on the load bearing rib. However, the curved profile of tension element 104 applies an upward thrust along the length of load bearing rib 100 that is opposite the direction of distributed load, L. In this manner, tension element 104 effectively carries a portion of the distributed load, L. In addition, chord element 101 is also placed in compression from the force imposed by the end support node due to the tension of the tension element. In this manner, each chord element is maintained in compression when tension element 104 is in a state of equivalent tension allowing the forces of each load bearing rib to remain in equilibrium without imposing external forces on structures outside of the rib.

In a further aspect, the depth of a web structure is not uniform along the length of a load bearing rib. In this manner, the bottom profile of a web structure is shaped to meet aesthetic or functional design objectives independent of the load carrying capability of the load bearing rib.

Figure 4A:
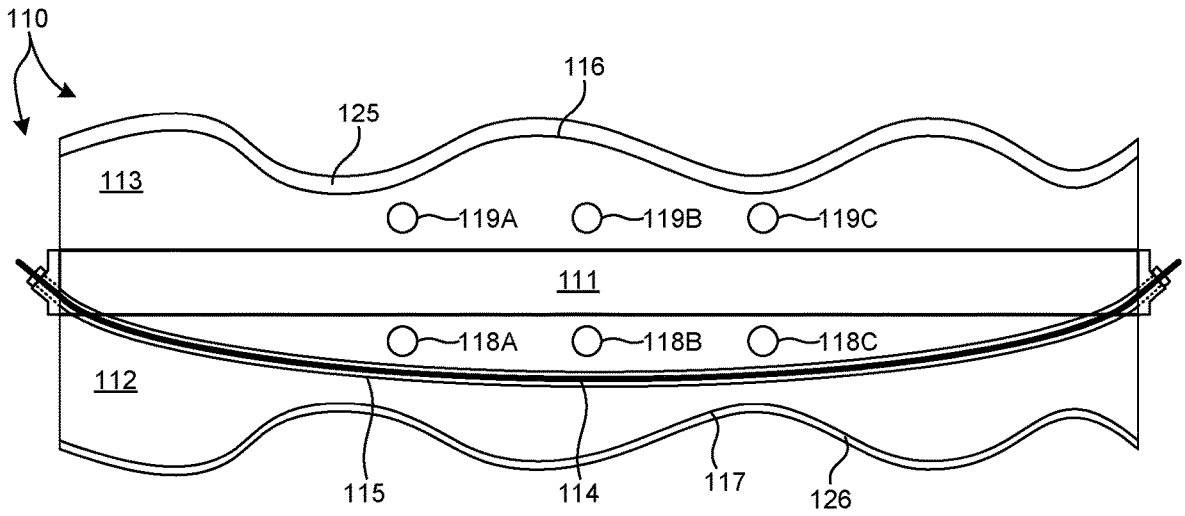
FIG. 4A is a diagram illustrative of a side view of a load bearing rib in another embodiment.

FIG. 4A is a diagram illustrative of a load bearing rib 110 in another embodiment. As depicted in FIG. 4A, load bearing rib 110 includes one or more chord elements 111, bottom web structure 112, top web structure 113, and tension element 114 positioned in tunnel 115. In addition, as depicted in FIG. 4A, the bottom profile 117 of bottom web structure 112 is variably shaped along the length of load bearing rib 110. This is in contrast to load bearing element 100 depicted in FIG. 1, where the bottom profile of the web structure 102 is a straight line (i.e., the depth of web structure 102 is uniform along the length of load bearing element 100.

In general, the one or more tension elements provide a suspension system associated with a load bearing rib as described herein. Thus, the material at the bottom web structure below the tension element does not influence the strength and deflection behavior of the load bearing rib. For this reason, the profile of the bottom web structure below the tension element may be selected to achieve a desired aesthetic effect.

Figure 4B:
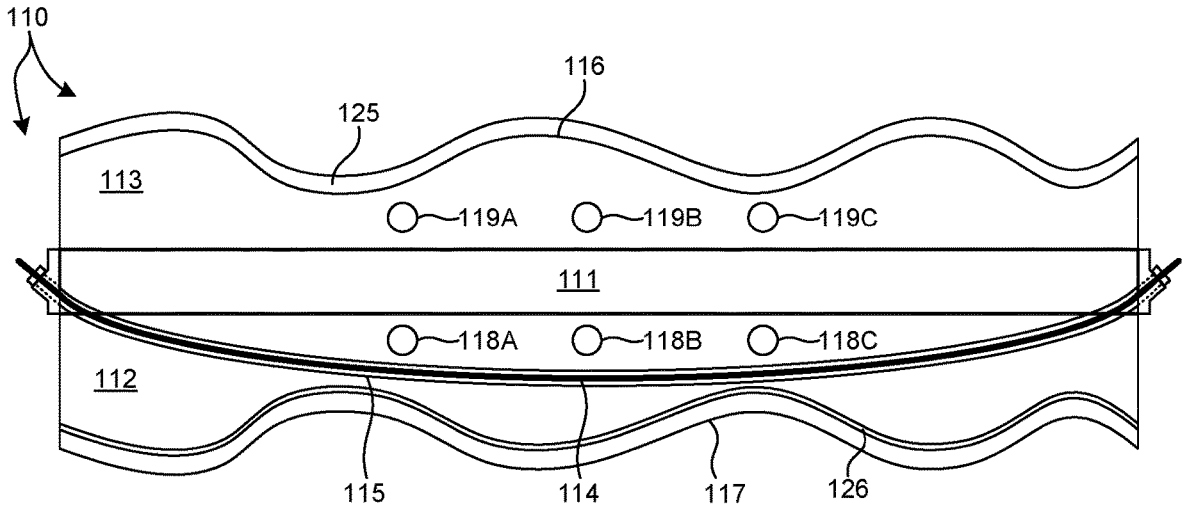
FIG. 4B is a diagram illustrative of a side view of a load bearing rib in another embodiment.

In some embodiments, all load bearing ribs of an array of load bearing ribs have the same bottom profile. In this manner, a two dimensional shape may be extended into the third dimension. In some embodiments, some or all load bearing ribs of an array of load bearing ribs have different bottom profiles. In these embodiments, the shape of the overall topography formed by the bottom profiles of the array of load bearing ribs is unique in three dimensions. In some embodiments, a ceiling is formed by exposure of the array of load bearing ribs to the room environment. In some other embodiments, a ceiling is formed using the array of load bearing ribs to support a ceiling subassembly having a complex three-dimensional profile visible to the room environment. FIGS. 4A and 4B depict a cross-sectional view of a ceiling subassembly 126 having a complex three-dimensional profile visible to the room environment. In some of these embodiments, a ceiling subassembly includes ceiling materials attached to the web structure such that the surface formed by the ceiling materials follows the contour of the bottom profile of the web structure as depicted in FIG. 4A. In some other embodiments, a ceiling subassembly includes ceiling materials attached to the web structure between the chord and the bottom profile of the web structure as depicted in FIG. 4B. In this manner, the ceiling materials occupy space between the web structures of adjacent ribs, but the bottom profile of the web structures remains visible to the room environment.

In some embodiments, the bottom profile of the bottom web structure is formed using the same cutting tools employed to form the tunnel 115 through which tension element 114 is embedded.

In a further aspect, the web structure includes one or more transverse penetrations, for example, to pass mechanical, electrical, and plumbing elements through the load bearing rib or for aesthetic purposes.

In general, the primary purpose of the web structure is to separate each top chord element and each tension element in the vertical direction. The tension elements are not bonded to the web structure and are free to slip within the tunnel, duct, or both. Thus, there is no induced shear force transferred between tension elements and compression chords, limiting the induced stress in the web structure to the relatively small vertical compression load due to the weight of the load bearing rib per unit length above the tension element, and the weight of a floor or roof assembly per unit length along the load bearing rib. Due to the limited loading of the web structure, itself, penetrations of varying size may be cut through the full web thickness or through a portion of the laminations of the web structure at any location of the web structure. Web structure penetrations may be of any shape, configuration, and size to accommodate mechanical, electrical, and plumbing components, aesthetic purposes, or other reasons provided sufficient web material remains above the tension elements and below the compression chord sufficient to support the weight per unit length along the load bearing rib. FIG. 4A depicts a number of web penetrations 118A-C through web structure 112 between chord element 111 and tension element 114.

In a further aspect, a load bearing rib includes a top web structure extending above the compression chord. In some embodiments, the height of the top web structure is uniform along the length of the load bearing rib as illustrated in FIG. 1. In some other embodiments, the height of the top web structure is non-uniform along the length of the load bearing rib as illustrated in FIG. 4A. In some embodiments, the top web structure includes penetrations through the web structure to accommodate mechanical, electrical, and plumbing components, aesthetic purposes, or other reasons.

As depicted in FIGS. 1-3, load bearing rib 100 includes a top web structure 103. The top web structure includes any suitable number of laminations. As depicted in FIG. 1, the height of the top web structure 103 is uniform and the top profile of the top web structure 103 is a straight line. As depicted in FIG. 4A, the height of top web structure 113 is not uniform and the top profile 116 of top web structure 113 is shaped to meet aesthetic design objectives independent of the load carrying capability of the load bearing rib. Moreover, in some embodiments, a top web structure includes penetrations. As depicted in FIG. 4A, top web structure 113 includes penetrations 119A-C.

In some embodiments, the top web structure is employed to support a roof subassembly that enables unique, customizable two or three dimensional roof profiles. In the embodiments depicted in FIGS. 4A and 4B, the top web structure 113 has a non-linear or sloping top profile 116, and roof subassembly 125 tracks the non-linear or sloping top profile of the top web structure 113. In this manner, each load bearing rib may include a unique top profile shaped to provide slope for roof drainage, provide different profile options to create an architectural roof scape, support a living roof, etc. In some embodiments, the finished roof level is located on top of each top profile, e.g., top profile 116, of each load bearing rib, but the roof diaphragm is located flat or in a sloping plane below the top profile and directly above and connected to the chord member. In this manner, the roof diaphragm laterally braces the compression chords and supports seismic, wind, and lateral loads, in addition to gravity loads. If a web structure extends more than a few inches above the diaphragm, intermittent vertical slots may be cut through the web structure, above the roof diaphragm, to remove compression loading in unbraced portions of the web structure that extend above the diaphragm to prevent compression over-stress, buckling, or both.

As depicted in FIG. 1, the top web structure 103 extends above the compression chord 101 and the bottom web structure 102 extends below the compression chord 101. As depicted in FIG. 3, the top web structure 103 and the bottom web structure 102 are fabricated together and share one or more laminations. However, in some other embodiments, the top web structure 103 and the bottom web structure 102 may be fabricated from different laminations and attached to compression chord 101 separately.

Figure 5:
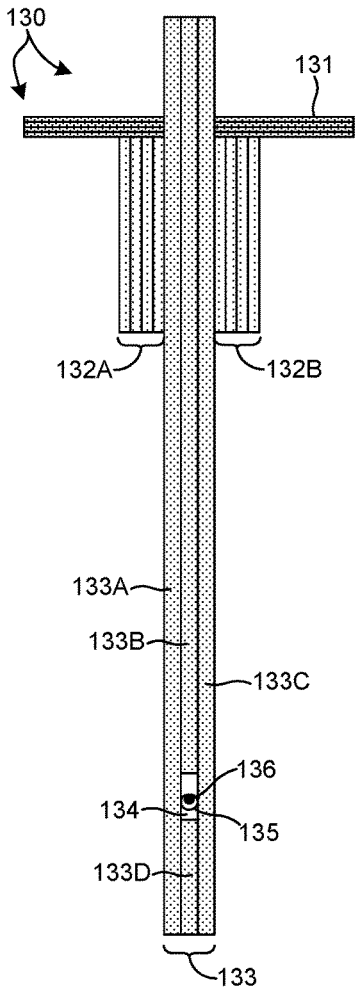
FIG. 5 is a diagram illustrative of a cross-sectional view of a load bearing rib and a diaphragm attached to the load bearing rib in one embodiment.

FIG. 5 is a diagram 130 illustrative of a cross-sectional view of a load bearing rib and a diaphragm attached to the load bearing rib. As depicted in FIG. 5, a web structure 133 extends both below and above compression chords 132A and 132B. The web structure includes exterior laminations 133A and 133C and interior laminations 133B and 133D. Interior laminations 133B and 133D are spaced apart from one another along the length of the load bearing rib, and together with exterior laminations 133A and 133C form a tunnel 134. A duct 135 is located within the tunnel 134 and a tension element 136 is located within the duct 135. Diaphragm 131 is attached to the top of chord elements 132A and 132B. Diaphragm 131 extends along the length of chord elements 132A and 132B and extends in a direction perpendicular to the depicted load bearing rib, and is attached to other load bearing ribs. In this manner, diaphragm 131 forms a structural plane connecting multiple load bearing ribs at the top of the compression chord elements to laterally brace the compression chords, support gravity loads, and support seismic loads.

In general, a roof diaphragm or a floor diaphragm is fastened to a load bearing rib in a conventional manner (e.g., adhesives, mechanical fasteners, or both). By way of non-limiting example, suitable diaphragm materials include plywood, tongue and groove decking, cross laminated timber, nail laminated timber, dowel laminated timber, steel decking, a composite concrete slab, and/or other systems suitable to span between load bearing ribs and support the given floor or roof gravity loads at the given spacing between load bearing ribs.

In a further aspect, load bearing ribs are manufactured off-site in linear sections and assembled and installed together, on-site.

In some embodiments, load bearing ribs are shipped and lifted into place on-site as a single continuous length. However, if the required length of a load bearing rib exceeds permitted shipping length or becomes impractical to fabricate, ship, or erect as a single unit, a load bearing rib is fabricated off-site and shipped in multiple sections and field spliced either prior to lifting in place or field spliced in place during field erection. The location of field splices is flexible because the forces born by the web structure are nominal along the entire length of the load bearing rib. In some embodiments, the sections are assembled on-site, the tension element(s) are threaded through the assembled load bearing rib, the assembled load bearing rib is lifted into place, and the tension element(s) are tensioned and locked into place as described hereinbefore.

In some embodiments, vertically oriented splices are generated by staggering outer and inner panel laminations horizontally along each vertical splice to create a tongue and groove joint. In some embodiments, horizontally oriented splices are generated by staggering outer and inner panel laminations vertically along each horizontal splice to create sufficient overlap between laminations for fastening. The laminations are connected by structural gluing, mechanically fastening, or both.

To assure the chord elements are maintained in compression, a splice connection between mating compression chords must fit tight in end-to-end bearing to maintain compression continuity. In some embodiments, a direct connection is employed. In some other embodiments, metal bracketry is employed to ensure the integrity of the field splice and prevent compression buckling. In some embodiments there is no direct connection employed, and the fastened diaphragm is employed to prevent compression buckling.

In some embodiments, each load bearing rib includes a single tension element as depicted by way of non-limiting example in FIGS. 3 and 5. In some other embodiments, each load bearing rib includes multiple tension elements located in the same interior lamination, different interior laminations, or both. The number and spacing of tension elements is determined to properly support the expected loads over the intended span length without over-stressing the tension element(s) or compression chord element(s).

Figure 6:
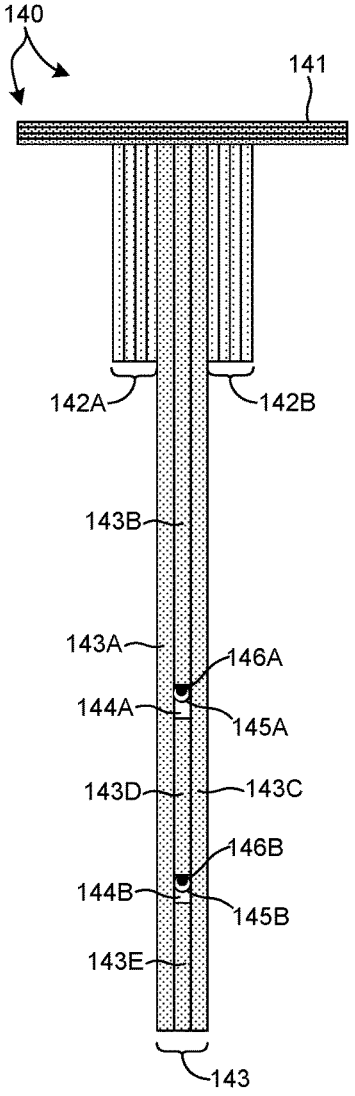
FIG. 6 is a diagram illustrative of multiple tension elements located in different locations of a single interior lamination.

FIG. 6 depicts multiple tension elements located in different locations of a single interior lamination. FIG. 6 depicts a diagram 140 illustrative of a cross-sectional view of a load bearing rib and a diaphragm attached to the load bearing rib. As depicted in FIG. 6, a web structure 143 extends both below compression chords 142A and 142B. Diaphragm 141 extends along the length of chord elements 142A and 142B and extends in a direction perpendicular to the depicted load bearing rib. The web structure 143 includes exterior laminations 143A and 143C and interior laminations 143B, 143D, and 143E. Interior laminations 143B and 143D are spaced apart from one another along the length of the load bearing rib, and together with exterior laminations 143A and 143C form a tunnel 144A. A duct 145A is located within the tunnel 144A and a tension element 146A is located within the duct 145A. Similarly, interior laminations 143D and 143E are spaced apart from one another along the length of the load bearing rib, and together with exterior laminations 143A and 143C form a tunnel 144B. A duct 145B is located within the tunnel 144B and a tension element 146B is located with the duct 145B. Interior lamination 143D is sized such that tension elements 146A and 146B are separated by a suitable distance (e.g., at least two inches) sufficient for the adhesive area that bonds inner to outer laminations to transfer a portion of distributed vertical forces along the rib length that is proportional to the tension in the lower tendon relative to the upper tension element(s).

Figure 7:
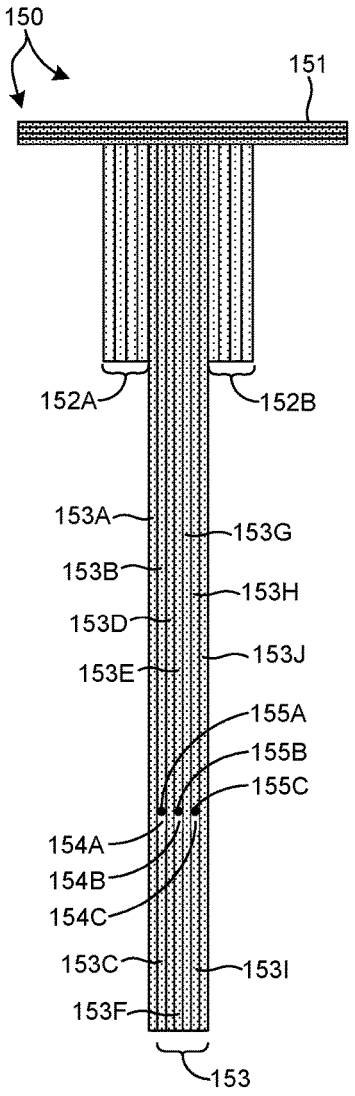
FIG. 7 is a diagram illustrative of multiple tension elements located in different interior laminations.

FIG. 7 depicts multiple tension elements located in different interior laminations. FIG. 7 is a diagram 150 illustrative of a cross-sectional view of a load bearing rib and a diaphragm attached to the load bearing rib. As depicted in FIG. 7, a web structure 153 extends below compression chords 152A and 152B. Diaphragm 151 extends along the length of chord elements 152A and 152B and extends in a direction perpendicular to the depicted load bearing rib. The web structure 153 includes exterior laminations 153A and 153J and interior laminations 153B-I. Interior laminations 153B and 153C are spaced apart from one another along the length of the load bearing rib, and together with laminations 153A and 153D form a tunnel 154A. A tension element 155A is located within tunnel 154A. Similarly, interior laminations 153E and 153F are spaced apart from one another along the length of the load bearing rib, and together with laminations 153D and 153G form a tunnel 154B. A tension element 155B is located within tunnel 154B. Similarly, interior laminations 153H and 153I are spaced apart from one another along the length of the load bearing rib, and together with laminations 153G and 153J form a tunnel 154C. A tension element 155C is located within tunnel 154C. Interior laminations 153D and 153G are sized such that tension elements 155A-C are separated by a suitable distance. In some other embodiments, interior laminations 153D and 153G are absent.

In a further aspect, a number of load bearing ribs are arranged in parallel in one direction to form a roof or floor of a building structure. In some embodiments, the array of load bearing ribs are arranged at regular spacing interval (e.g., spaced with a distance in a range from two feet to twenty feet). An arrangement of load bearing ribs in a single direction is particularly well suited for minimum cost and moderate span lengths.

In a further aspect, a number of load bearing ribs arranged in parallel in one direction are laterally braced at the bottom web structure to stabilize the roof or floor structure under gravity loading, seismic loading, and wind loading. Gravity loading of a load bearing rib is a vertical load carried by an installed load bearing rib and the dead load portion of this load, due to building material weights, is sustained at all times. However, a slight horizontal offset of the high tension load of the tension element may cause a lateral instability of the rib structure. In addition, seismic or wind events give rise to intermittent lateral forces or uplift forces that may potentially destabilize the load bearing rib structure and cause buckling. To counteract these forces, the load bearing ribs are cross-braced at or near the bottom of the bottom web structure to laterally brace the ribs out of plane of the rib span direction. The bracing is achieved by connecting the bottom web structures of adjacent load bearing ribs in a direction perpendicular to the span of the load bearing rib with a bracing element. By way of non-limiting example, a bracing element includes a pipe, a timber member, a cable connected to the web structure, etc.

Figure 8:
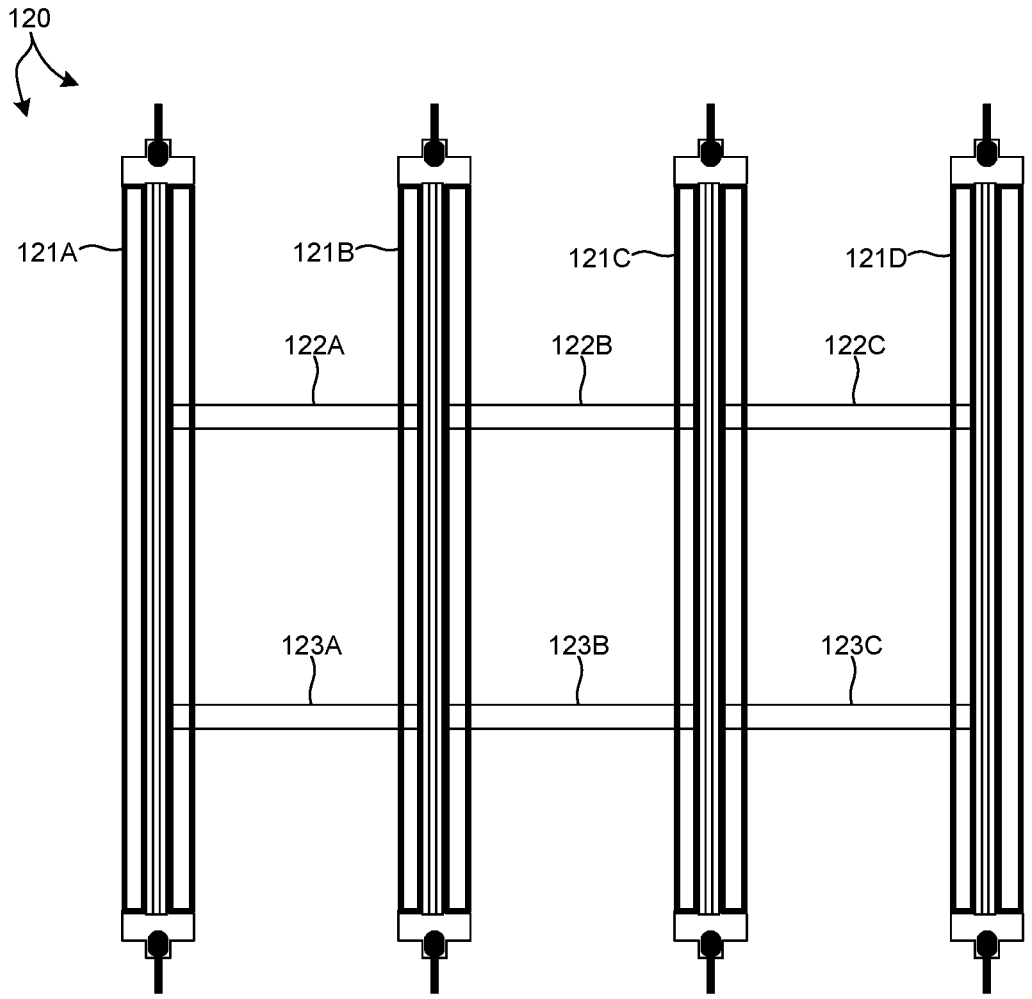
FIG. 8 is a diagram illustrative of a top view of a floor or roof structure including load bearing ribs interconnected by lateral bracing elements.

FIG. 8 depicts a top view of a floor or roof structure 120 including load bearing ribs 121A-D arranged in parallel and spaced apart at regular intervals. As depicted in FIG. 8, lateral bracing elements 122A and 123A connect load bearing ribs 121A and 121B in a direction different from the span direction of the load bearing ribs at or near the bottom of their respective bottom web structures. Similarly, lateral bracing elements 122B and 123B connect load bearing ribs 121B and 121C in a direction different from the span direction of the load bearing ribs at or near the bottom of their respective bottom web structures. Finally, lateral bracing elements 122C and 123C connect load bearing ribs 121C and 121D in a direction perpendicular to the span direction of the load bearing ribs at or near the bottom of their respective bottom web structures.

In a further aspect, a number of load bearing ribs are arranged in two different directions in a grid configuration to form a roof or floor of a building structure. In this arrangement, the arrangement of load bearing ribs oriented in one direction effectively braces the load bearing ribs arranged in a different direction to stabilize the roof or floor structure under gravity, seismic, and wind loads.

In some embodiments, the two dimensional array of load bearing ribs are arranged at regular spacing intervals in both directions (e.g., evenly spaced with a distance in a range from two feet to twenty feet in both directions). An arrangement of load bearing ribs in two directions is particularly well suited for longer span lengths, reduced rib depth, complex three-dimensional ceiling profiles using the two dimensional array as either an exposed grid system or as a falsework for ceiling finishes, three-dimensional roof structure to support complex roof drainage patterns, a unique aesthetic roof scape, wind break, green roof scape, etc.

Figure 9:
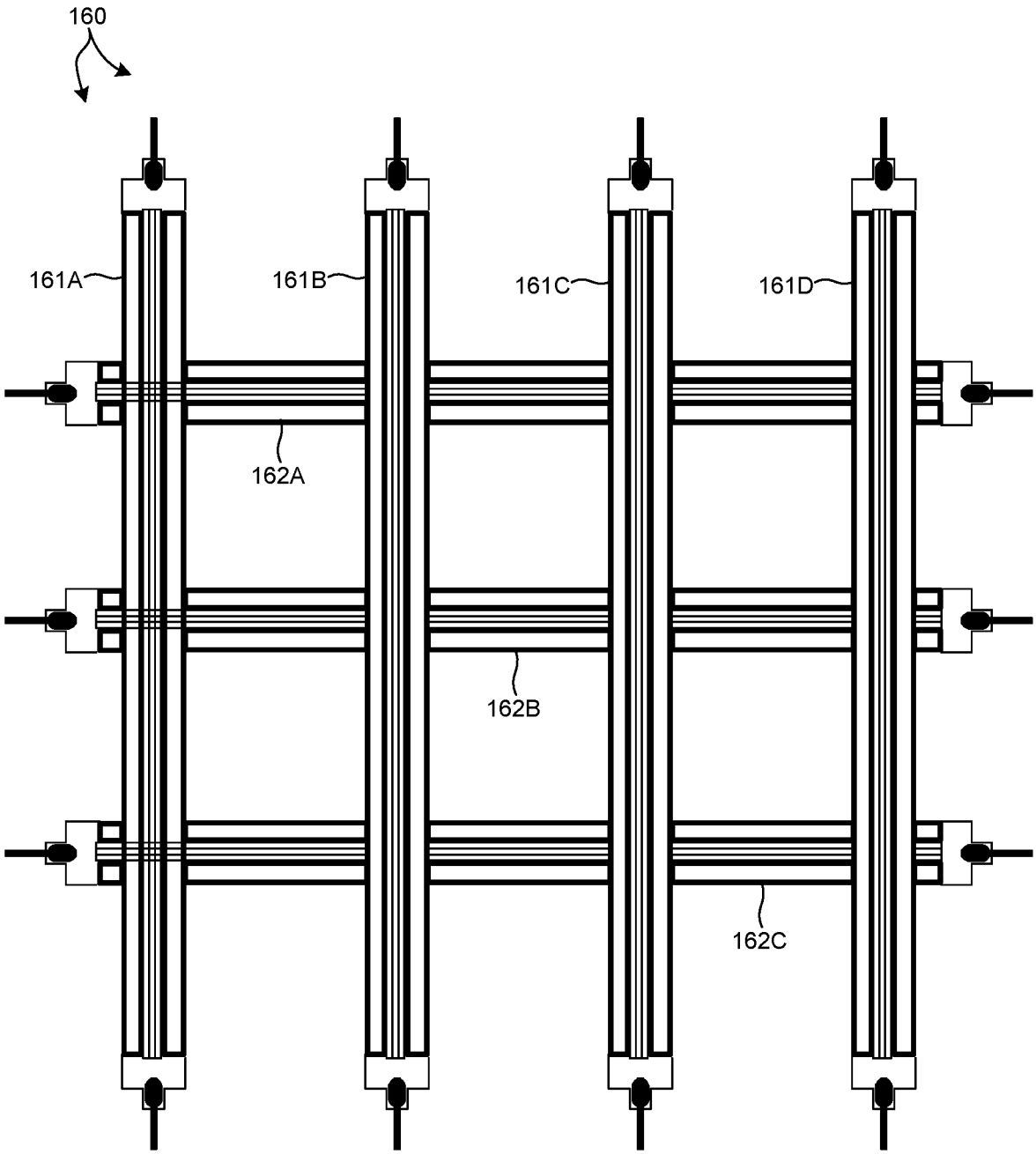
FIG. 9 is a diagram illustrative of a top view of a floor or roof structure including load bearing ribs arranged in different directions.
Figure 10A:
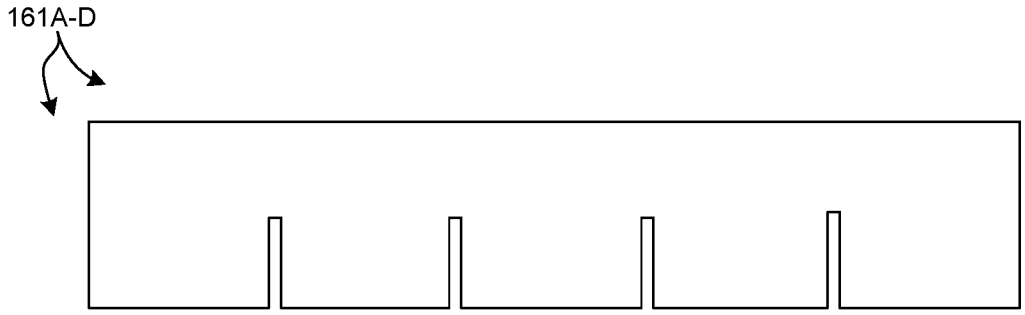
FIGS. 10A-10B are diagrams illustrative of side views of load bearing ribs slotted to interlock in two different span directions.
Figure 10B:
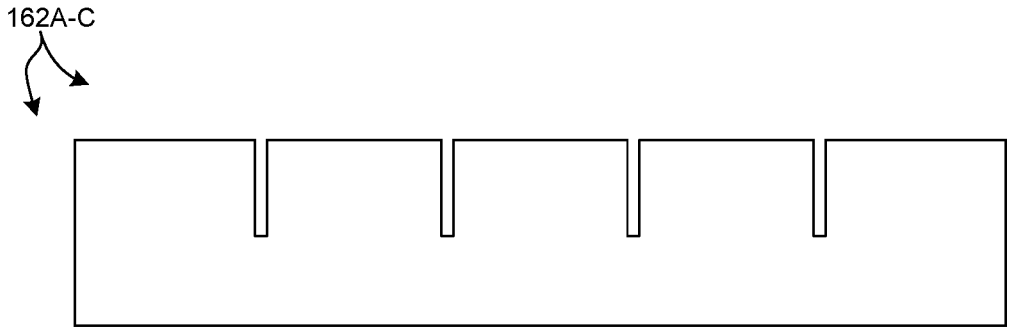

FIG. 9 depicts a floor or roof structure 160 including load bearing ribs 161A-D arranged in parallel and spaced apart, and load bearing ribs 162A-C arranged in a different direction, perpendicular in some embodiments and not perpendicular in other embodiments, to load bearing ribs 161A-D and spaced apart. In one embodiment, load bearing ribs 161A-D are slotted from mid-depth to bottom as depicted in FIG. 10A, and load bearing ribs 162A-C are slotted from top to mid-depth as depicted in FIG. 10B. This allows the load bearing ribs to slide together during erection. If load bearing ribs are the same depth, holes in transverse load bearing ribs are drilled to allow the tension elements to thread through crossing load bearing ribs in each direction. Chord members can be continuous and attached to the load bearing ribs in one direction. However, in the different direction, chord members are either shop cut and field installed to fit tightly between the continuous chord elements or field cut and field installed to generate the tight fit.

As described hereinbefore, each load bearing rib is supported at both ends by an end support node suitable to support the required horizontal and vertical loads including, but not limited to, the live load associated with the proposed floor or roof usage, the dead load associated with the weight of the load bearing ribs, floor or roof assembly, any applicable ceiling assembly, and wind and seismic forces. Depending on the length of the span, end support nodes may include wood, steel, concrete, masonry or any other common building material.

Since the vertical loads are largely supported by the tension elements, each end connection node must be able to perform a number of functions including: serve as a reaction block during tensioning of the tension elements, transfer the vertical load component from the tension elements into the supporting structure below, and transfer the horizontal component of the tensile force in the tension elements to the compression chord member (s) near the top of each load bearing rib. To avoid inducing more flexure into the load bearing ribs and chord members, the point of anchorage of a tension element is generally aligned with the vertical centroid of the chord member (s).

In general, an end support node includes a reaction plate comprising steel angle, channel, or other structural steel shape at which the end of the chord member (s) terminate. The end support node bears against a timber, steel, concrete, or built-up light gauge steel framing column. The framing column may be an isolated column or placed within a framed wall. The end support node includes a locking element to maintain tension in the tensioning element, and optionally a steel wedge structure to align the tensioning element with the reaction plate. In general, a steel wedge structure includes a surface that is perpendicular to the tension element as the tension element exits the load bearing rib and another surface that is aligned with the reaction plate. The wedge structure may be fastened (e.g., screwed, bolted, welded) to the reaction plate of the end support node.

In some embodiments, the end support nodes are integrated with each load bearing rib and tensioned off-site, on-site, or both. In these embodiments, the tensioned load bearing ribs are placed on-site, and the integrated end support nodes are fastened to the building structure.

In some embodiments, an end support node is integrated with a framing post and the load bearing rib is attached to the end support node during placement of the load bearing rib, and tensioned after placement.

In general, the tensioning of the tension element is performed from one end of each load bearing rib or both ends of each load bearing rib if appropriate to minimize frictional drag along the length of the tension element.

Figure 11:
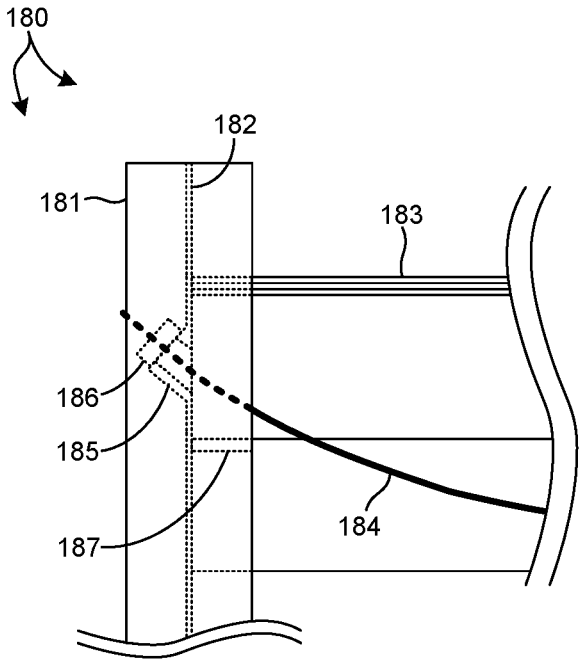
FIG. 11 is a diagram illustrative of a side view of an assembly of an end support node and a load bearing rib in one embodiment.
Figure 12:
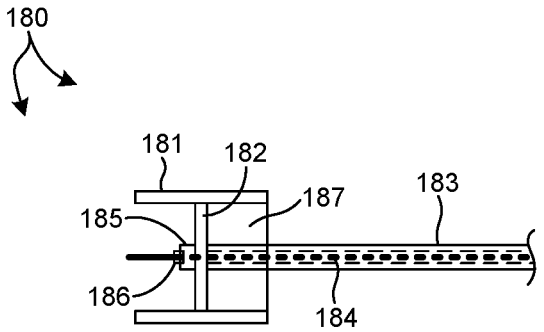
FIG. 12 is a diagram illustrative of a top view of the assembly illustrated in FIG. 11.

FIG. 11 depicts a side view of an assembly 180 of an end support node and a load bearing rib in one embodiment. FIG. 12 depicts a top view of the assembly 180 illustrated in FIG. 11. As depicted in FIGS. 11 and 12, framing column 181 is a steel structure having a web 182. In some embodiments, framing column 181 is a steel element having a wide flange section including a web 182 and two flanges on each side of the web. Furthermore, a horizontally oriented support plate 187 is welded to the wide flange column 181 across the width of the web 182 and to both flanges on the side of the wide flange web that bears against the end of the compression chord. In this manner, vertical support plate 187 spans along the web 182 between flanges of the framing column 181 on the side of the load bearing rib 183. The bottom of the chord members of the load bearing rib 183 rest on the vertical support plate 187, and vertical support plate 187 supports the vertical load component of the load bearing rib.

In addition, the end of the chord members fits up against the web 182 of the column 181. In this manner, web 182 is the reaction plate of the end support node. Tension element 184 extends through a hole in web 182 at approximately the middle of the depth of the chord members and through wedge 185. A tensioning device pulls on tension element 184 and pushes against web 182 and/or wedge 185 until the desired tension of tension element 184 is reached. A locking element 186 (e.g., clamp, nut, wedge, etc.) locks tension element 184 to an anchorage system that bears against web 182 to maintain the tension after removal of the tensioning device.

In some embodiments, an end support node is connected to either the framing column or the load bearing rib before rib placement and the load bearing rib is tensioned after placement.

Figure 13:
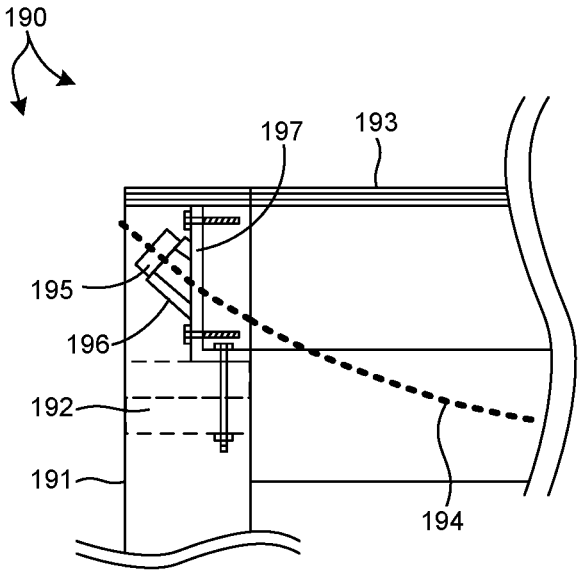
FIG. 13 is a diagram illustrative of a side view of an assembly of an end support node and a load bearing rib in another embodiment.

FIG. 13 depicts a side view of an assembly 190 of an end support node and a load bearing rib 193 in one embodiment. As depicted in FIG. 13, framing post 191 is a steel or timber post upon which one or more steel or timber plates 192 are attached. Furthermore, an L-shaped steel member 197 is mechanically fastened to both the plates 192 and the end of the chord member of the load bearing rib 193. In some other embodiments, the L-shaped steel member 197 is attached to the chord member (s) which are shop connected to load bearing rib, load bearing rib 193 is then placed in position, and finally L-shaped steel member 197 is attached to plates 192.

The bottom of the chord members of the load bearing rib 193 rests on a horizontally oriented leg of the L-shaped steel member 197 (a.k.a., steel angle). In addition, the end of the chord members fits up against a vertically oriented leg of the L-shaped steel member 197. In this manner, the L-shaped steel member 197 is the reaction plate of the end support node. Tension element 194 extends through a hole in L-shaped steel member 197 and wedge 196 at approximately the middle of the depth of the chord members.

A tensioning device (e.g., a stressing or hydraulic jack) pulls on tension element 194 and pushes against L-shaped steel member 197 via steel wedge element 196 until the desired tension of tension element 194 is reached. The L-shaped steel member acts as an anchorage plate and the steel wedge element 196 includes a surface that is perpendicular to the tension element as the tension element exits the load bearing rib. A locking element 195 (e.g., clamp, nut, wedge, etc.) locks tension element 194 to L-shaped steel member 197 to maintain the tension after removal of the tensioning device.

In some embodiments, an end support node is integrated with a wide flange column segment. In some of these embodiments, the load bearing rib is attached to the wide flange column segment during placement of the load bearing rib, and tensioned after placement. In some of these embodiments, the load bearing rib is attached to the wide flange column segment, and tensioned before and/or after placement of the load bearing rib.

Figure 14:
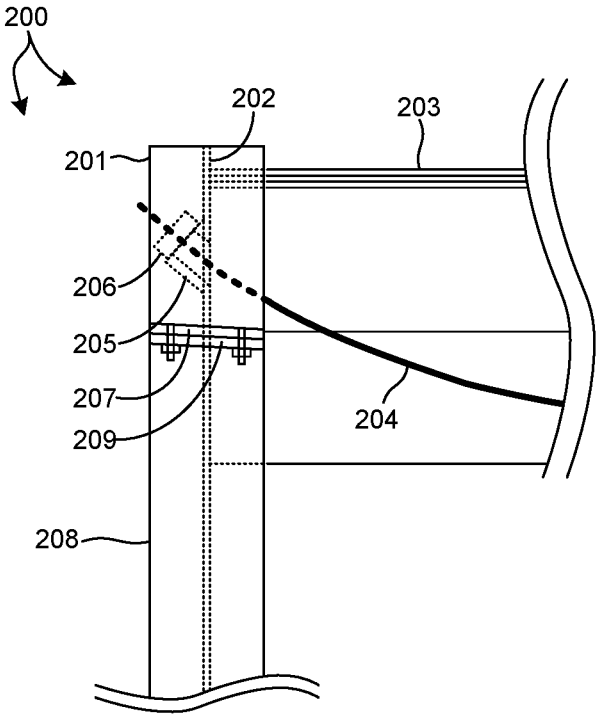
FIG. 14 is a diagram illustrative of a side view of an assembly of an end support node and a load bearing rib in yet another embodiment.

FIG. 14 depicts a side view of an assembly 200 of an end support node 201 and a load bearing rib 203 in one embodiment. As depicted in FIG. 14, framing post 208 is a steel or timber post upon which a wide flange column segment 201 is attached. The wide flange column segment 201 includes a bearing plate 207 that is bolted to a mating bearing plate 209 of framing post 208. In some embodiments, wide flange column segment 201 includes a steel element having a wide flange section including a web 202 and two flanges on each side of the web. Furthermore, flange 207 is welded to the wide flange column segment across the width of the web 202 and to both flanges on the side of the wide flange web that bears against the end of the compression chord. In this manner, bearing plate 207 spans along the web 202 and between flanges of the wide flange column segment 201 on the side of the load bearing rib 203. The bottom of the chord members of the load bearing rib 203 rest on the bearing plate 207, and plate 207 supports the vertical load component of the load bearing rib.

In addition, the end of the chord members fits up against web 202. In this manner, web 202 is the reaction plate of the end support node. Tension element 204 extends through a hole in web 202 at approximately the middle of the depth of the chord members and through wedge 205. A tensioning device pulls on tension element 204 and pushes against web 202 and/or wedge 205 until the desired tension of tension element 204 is reached. A locking element 206 (e.g., clamp, nut, wedge, etc.) locks tension element 204 to an anchorage system that bears against web 202 to maintain the tension after removal of the tensioning device.

In some embodiments, the tension elements are tensioned to the desired stress level after the load bearing ribs are erected. In another embodiment, the tension elements are partially tensioned prior to erection and again tensioned after erection of load bearing ribs. In some examples, the tension elements are slightly over tensioned to account for top chord elastic and creep shortening. In some examples, the tension elements are tensioned multiple times over their lifetime to account for realized top chord elastic and creep shortening.

Commercially available hydraulic jacks may be employed to stress each tension element. The induced stress may be measured directly using a stress gauge or may be inferred based on measured elongation (i.e., a measure of stain) and the known mechanical properties of the tension element.

Figure 15:
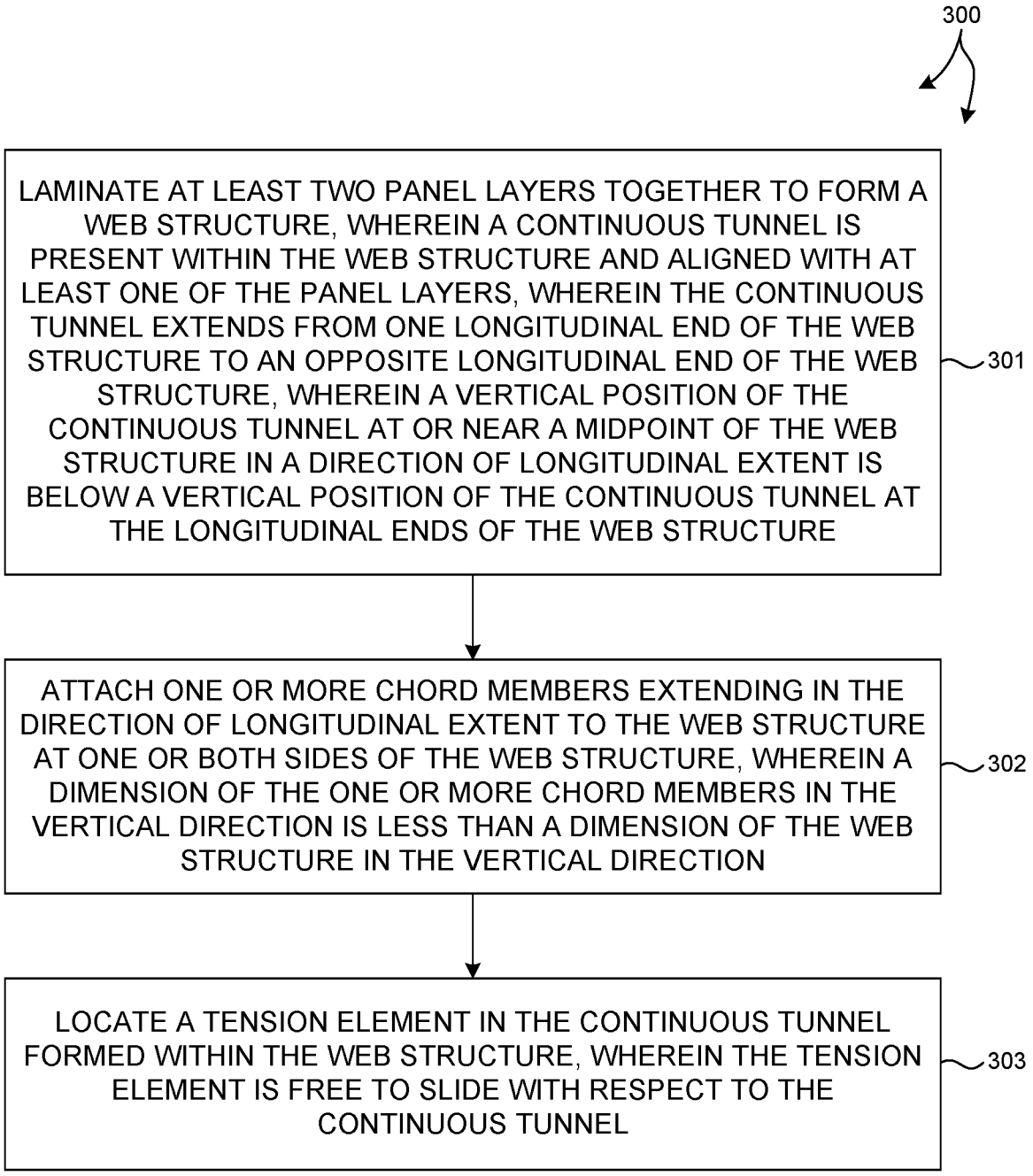
FIG. 15 illustrates a method 300 suitable for producing a load bearing rib structure in accordance with at least one inventive aspect.

FIG. 15 illustrates a method 300 suitable for producing a load bearing rib structure in accordance with at least one inventive aspect.

In block 301, at least two panel layers are laminated together to form a web structure. A continuous tunnel is present within the web structure and aligned with at least one of the panel layers. The continuous tunnel extends from one longitudinal end of the web structure to an opposite longitudinal end of the web structure. A vertical position of the continuous tunnel at or near a midpoint of the web structure in a direction of longitudinal extent is below a vertical position of the continuous tunnel at the longitudinal ends of the web structure.

In block 302, one or more chord members extending in the direction of longitudinal extent are attached to the web structure at one or both sides of the web structure. A dimension of the one or more chord members in the vertical direction is less than a dimension of the web structure in the vertical direction.

In block 303, a tension element is located through the continuous tunnel formed within the web structure. The tension element is free to slide with respect to the continuous tunnel.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An integrated framing system, comprising:

a plurality of load bearing rib structures each having a direction of longitudinal extent and a cross-sectional shape extending in a vertical direction and a horizontal direction, both the vertical direction and the horizontal direction perpendicular to the direction of longitudinal extent, each load bearing rib structure configured to support a load having a component aligned substantially with the vertical direction, each load bearing rib structure comprising:

a web structure comprising at least two panel layers laminated together, each having a dimension in the direction of longitudinal extent and a dimension in the vertical direction that are substantially greater than a dimension in the horizontal direction, wherein a first continuous tunnel is present within the web structure and aligned with at least one of the panels, wherein the first continuous tunnel extends substantially from one longitudinal end of the web structure to an opposite longitudinal end of the web structure, wherein a vertical position of the first continuous tunnel at or near a midpoint of the web structure in the direction of longitudinal extent is below a vertical position of the first continuous tunnel at the longitudinal ends of the web structure;

a chord member extending in the direction of longitudinal extent adjacent to the web structure at one or both sides of the web structure, wherein a dimension of the chord member in the vertical direction is less than a dimension of the web structure in the vertical direction, and wherein the web structure extends in the vertical direction above the chord member and below the chord member; and a first tension element disposed in the first continuous tunnel formed within the web structure, wherein the first tension element is free to slide with respect to the first continuous tunnel.

2. The integrated framing system of claim 1, further comprising:

a plurality of end support nodes, each end support node coupled to an end of a load bearing rib structure, wherein a first end support node is coupled to one end of the chord member of a load bearing rib structure, and a second end support node is coupled to an opposite end of the chord member, wherein the first tension element of the load bearing structure is fixed with respect to the first and second end support nodes in a state of tensile stress.

3. The integrated framing system of claim 1, wherein a path traced by the first continuous tunnel is shaped as a curve having zero slope at a single location between the endpoints of the load bearing rib structure.

4. The integrated framing system of claim 1, further comprising:

a duct fit within at least a portion of the first continuous tunnel, wherein the tension element is disposed in the duct.

5. The integrated framing system of claim 1, further comprising:

a penetration through a thickness of the web structure located between the chord member and the first continuous tunnel.

6. The integrated framing system of claim 1, wherein the plurality of load bearing rib structures are oriented in parallel in a first direction and spaced apart in a direction different from the first direction.

7. The integrated framing system of claim 6, further comprising:

a lateral bracing element oriented in the direction different from the first direction, the lateral bracing element coupled to a web structure of a first load bearing rib of the plurality of load bearing ribs and coupled to a web structure of a second load bearing rib of the plurality of load bearing ribs.

8. The integrated framing system of claim 1, wherein a first portion of the plurality of load bearing ribs are oriented in parallel in a first direction and spaced apart in a second direction different from the first direction, and wherein a second portion of the plurality of load bearing ribs are oriented in parallel in the second direction and spaced apart in the first direction, wherein the first portion of load bearing ribs are slotted from the bottom, wherein the second portion of load bearing ribs are slotted from the top, and wherein the slotted portions of the first portion of load bearing ribs are aligned with respect to the slotted portions of the second portion of load bearing ribs.

9. The integrated framing system of claim 1, wherein a depth of the web structure below the chord member is not uniform along a length of a load bearing rib, wherein a height of the web structure above the chord member is not uniform along a length of a load bearing rib, or both.

10. The integrated framing system of claim 1, further comprising:

a roof subassembly coupled to the web structure above the chord member.

11. The integrated framing system of claim 10, the web structure having a sloped or non-linear top profile, wherein the roof subassembly tracks the sloped or non-linear top profile of the web structure.

12. The integrated framing system of claim 1, the web structure including one or more slots extending above the chord member to a top of the web structure.

13. The integrated framing system of claim 1, further comprising:

a ceiling subassembly coupled to the web structure below the chord member.

14. The integrated framing system of claim 13, the web structure having a sloped or non-linear bottom profile, wherein the ceiling subassembly is attached to the sloped or non-linear bottom profile of the web structure.

15. The integrated framing system of claim 13, the web structure having a bottom profile, wherein the ceiling subassembly is attached to the web structure between the bottom profile of the web structure and the chord member.

16. The integrated framing system of claim 1, wherein the tension element is any of a high strength cable, a bar, a rod, and a strand.

17. The integrated framing system of claim 1, wherein each panel layer of the web structure is any of a plywood panel, an oriented strand board panel, a manufactured wood framing member, a fiber cement board panel, a composite sheet panel, and a plastic laminate panel.

18. The integrated framing system of claim 1, the web structure further comprising:

a second continuous tunnel present within the web structure, wherein the second continuous tunnel extends from the one longitudinal end of the web structure to the opposite longitudinal end of the web structure; and a second tension element disposed in the second continuous tunnel formed within the web structure, wherein the second tension element is free to slide with respect to the second continuous tunnel.

19. The integrated framing system of claim 18, wherein a vertical position of the second continuous tunnel is below the first continuous tunnel of the web structure.

20. A load bearing rib structure, comprising:

a web structure comprising at least two panel layers laminated together, each having a dimension in the direction of longitudinal extent and a dimension in the vertical direction that are substantially greater than a dimension in the horizontal direction, wherein a continuous tunnel is present within the panel layers and aligned with at least one of the panels, wherein the first continuous tunnel extends substantially from one longitudinal end of the web structure to an opposite longitudinal end of the web structure, wherein a vertical position of the first continuous tunnel at or near a midpoint of the web structure in the direction of longitudinal extent is below a vertical position of the continuous tunnel at the longitudinal ends of the web structure;

a chord member extending in the direction of longitudinal extent adjacent to the web structure at one or both sides of the web structure, wherein a dimension of the chord member in the vertical direction is less than a dimension of the web structure in the vertical direction, wherein the web structure extends in the vertical direction above the chord member, extends in the vertical direction below the chord member, or both, and wherein a depth of the web structure below the chord member has a non-linear profile along a length of a load bearing rib, a height of the web structure above the chord member has a non-linear profile along a length of a load bearing rib, or both; and a tension element disposed in the continuous tunnel formed within the web structure, wherein the tension element is free to slide with respect to the continuous tunnel.

21. The load bearing rib structure of claim 20, further comprising:

a first end support node coupled to one end of the chord member of the load bearing rib structure;

a second end support node coupled to an opposite end of the chord member, wherein the tension element of the load bearing structure is fixed with respect to the first and second end support nodes in a state of tensile stress.

22. A method comprising:

laminating at least two panel layers together to form a web structure, wherein a continuous tunnel is present within the panel layers and aligned with at least one of the panel layers, wherein the continuous tunnel extends from one longitudinal end of the web structure to an opposite longitudinal end of the web structure, wherein a vertical position of the continuous tunnel at or near a midpoint of the web structure in a direction of longitudinal extent is below a vertical position of the continuous tunnel at the longitudinal ends of the web structure;

attaching a chord member extending in the direction of longitudinal extent to the web structure at one or both sides of the web structure, wherein a dimension of the chord member in the vertical direction is less than a dimension of the web structure in the vertical direction, wherein the web structure extends in the vertical direction above the chord member, extends in the vertical direction below the chord member, or both, and wherein a depth of the web structure below the chord member has a non-linear profile along a length of a load bearing rib, a height of the web structure above the chord member has a non-linear profile along a length of a load bearing rib, or both; and locating a tension element through the continuous tunnel formed within the web structure, wherein the tension element is free to slide with respect to the continuous tunnel.

23. The method of claim 22, further comprising:

tensioning the tension element against a first end support node coupled to one end of the chord member of the load bearing rib structure; and fixing the tension element of the load bearing structure with respect to the first and second end support nodes in a state of tensile stress.

24. The integrated framing system of claim 1, wherein a depth of the web structure below the chord member has a sloping profile along a length of a load bearing rib, wherein a height of the web structure above the chord member has a sloping profile along a length of a load bearing rib, or both.

25. The integrated framing system of claim 1, wherein a depth of the web structure below the chord member has a non-linear profile along a length of a load bearing rib, wherein a height of the web structure above the chord member has a non-linear profile along a length of a load bearing rib, or both.

* * * * *